United States Patent [19]

Ocel et al.

[11] 4,146,265

[45] Mar. 27, 1979

[54] CATHETER BAG HOLDER FOR WHEELCHAIRS

[75] Inventors: John J. Ocel; Thomas Ocel, both of Minneapolis, Minn.

[73] Assignee: Ocelco, Inc., Minneapolis, Minn.

[21] Appl. No.: 922,969

[22] Filed: Jul. 10, 1978

[51] Int. Cl.[2] ..... A47C 7/62

[52] U.S. Cl. ..... 297/188; 248/100; 297/DIG. 4

[58] Field of Search ..... 297/192, 188, 189, 193, 297/DIG. 4; 248/95, 100, 293, 226.1, 295 R, 298; 4/134, 341, 228, 227, 231; 5/317, 92; 128/275, 295

[56] References Cited

U.S. PATENT DOCUMENTS

| | | | |
|---|---|---|---|
| 752,425 | 2/1904 | Spangler | 248/259 |
| 939,508 | 11/1909 | Hull | 248/95 |
| 2,163,759 | 6/1939 | McCann | 248/95 X |
| 2,328,252 | 8/1943 | Barker | 248/226.1 |
| 3,345,023 | 10/1967 | Scott et al. | 248/95 |
| 3,534,738 | 10/1970 | Huck | 248/95 |
| 3,568,965 | 3/1971 | Clark | 248/95 |
| 3,896,809 | 7/1975 | Samuel et al. | 128/275 |

*Primary Examiner*—James T. McCall

*Attorney, Agent, or Firm*—Orrin M. Haugen; Thomas J. Nikolai

[57] ABSTRACT

An adjustable bracket which is adapted to be mounted with screws between the rear side frame elements of a wheelchair for suspending a catheter bag therefrom and which includes a pair of bag stabilizing extensions for preventing the bag from swinging during use. Because the bracket is adjustable in length, it can be made to accommodate wheelchair frames of varying sizes. In an alternative embodiment, the catheter bag support bracket is pivotally attached to only one of the rear side members of the wheelchair so that it may be rotated from a generally horizontal orientation to a vertical orientation when not in use.

6 Claims, 3 Drawing Figures

CATHETER BAG HOLDER FOR WHEELCHAIRS

BACKGROUND OF THE INVENTION

I. Field of the Invention

This invention relates to an accessory for an invalid's wheelchair, and more specifically to a bracket arrangement which may conveniently be used to suspend and hold a catheter bag on the rear of a wheelchair and below the seat thereof so that body fluids may be drained into it while the patient is occupying the wheelchair.

II. Description of the Prior Art

Various arrangements are known in the art for mounting fluid receptacles on a wheelchair such that body fluids may be collected in a sanitary and otherwise unobjectionable fashion. For example, reference is made to the Samuel et al U.S. Pat No. 3,896,809 in which an elongated rod of adjustable length has a clamp arrangement at one end for gripping the conventional flexible fabric back piece of a wheelchair and which includes a hook along its length from which may be supported a catheter bag. On the opposite end of the elongated adjustable strip from the upper back clamp is a plate having a plurality of routing hooks for supporting the catheter tube and routing it from the patient to the inlet of the catheter bag.

Another prior art approach is disclosed in the Miller U.S. Pat. No. 3,787,903. In this arrangement, the seat of the wheelchair is made from a water-proof upholstery material and located beneath the seat is a urine collection shield arranged such that when a patient urinates, the fluid will be collected within the shield and can later be drained therefrom.

Drawbacks inherent in the apparatus of the Miller patent are immediately apparent. Because the urine shield fits loosely about the seat, objectionable odors are not trapped which would naturally lead to embarrassment for the patient. While the device of the Samuel et al Patent allows a collection bag which is generally sealed to be utilized, the mounting arrangement permits the collection bag to swing back and forth beneath the chair as the patient puts the wheelchair in motion which is also a generally objectionable condition. Then too, the bracket of the Samuel et al patent is somewhat costly to manufacture and may not be universally applicable to a wide variety of wheelchair designs.

SUMMARY OF THE INVENTION

The catheter bag holder of the present invention is designed to obviate the various problems heretofore exhibited by prior art devices designed for related purposes.

In one embodiment, the invention comprises a bracket which is made adjustable in length and which is adapted to be horizontally mounted with screws between the rear side frame elements of a wheelchair proximate the level of the wheelchair seat and which includes a pair of bag stabilizing extensions and a hook member for supporting the handle of a conventional catheter bag. Because the horizontally extending bracket is adjustable in length, it can be readily utilized with a wide variety of wheelchairs.

In an alternative embodiment, the catheter bag holder comprises a first bracket which is adapted to be mounted on the left rear side support member of a wheelchair and which has pivotally attached thereto a cross member which may be rotated from a generally vertical orientation where it is out of the way to a generally horizontal disposition when it is to be utilized for supporting a catheter bag. Again, a bag stabilizing member is attached to the rotatable member to prevent the bag from swinging back and forth. Integrally formed finger extensions on the cross member are utilized to grip the handle of a conventional catheter bag and hold it in its proper orientation.

In either embodiment, the parts may be fabricated from steel, aluminum or a suitable molded plastic. As such, the devices of either embodiment are relatively inexpensive to manufacture, yet, are extremely effective in operation.

OBJECTS

It is accordingly the principal object of the present invention to provide a new and improved design for a catheter bag supporting member attachment for a wheelchair.

Another object of the invention is to provide a catheter bag support member for a wheelchair which effectively prevents the bag from swaying during motion of the wheelchair.

Still another object of the invention is to provide a catheter bag mounting structure for a wheelchair which is simple in construction, inexpensive to manufacture, universally applicable to a wide variety of wheelchairs and which may be utilized to suspend a catheter bag at a location which is, relatively speaking, out of sight.

These and other objects and advantages of the invention will become apparent to those skilled in the art from the following detailed description of the preferred embodiments thereof and the accompanying drawings.

DESCRIPTION OF THE PREFERRED EMBODIMENT

Figure 1:
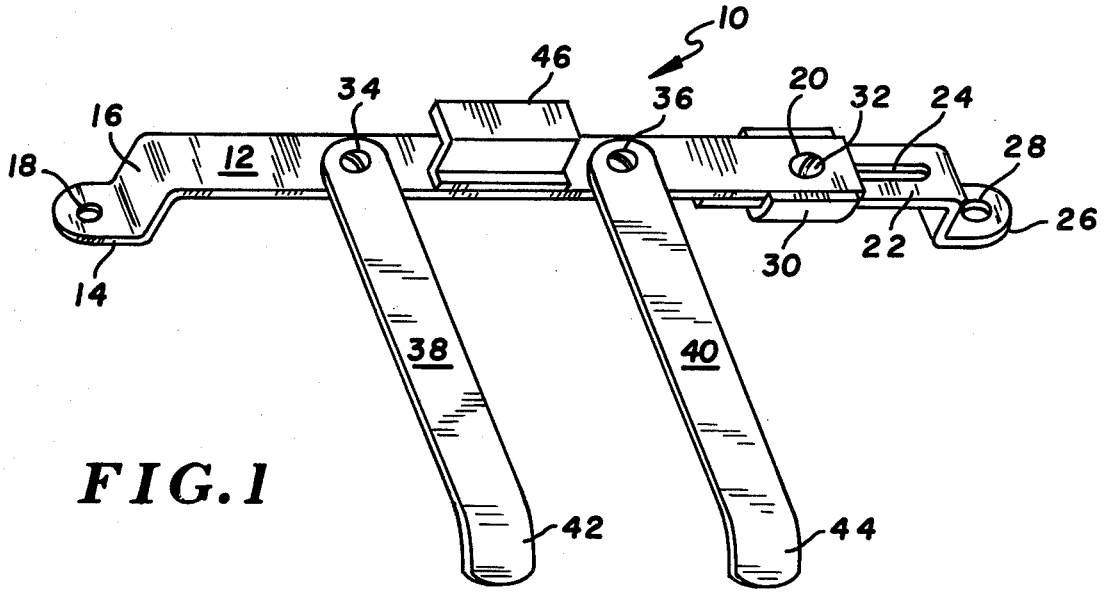
FIG. 1 is a perspective view of a first embodiment of the invention.

Referring first to FIG. 1, there is indicated generally by numeral 10 a catheter bag supporting member for a wheelchair which forms one embodiment of the present invention. The apparatus comprises a first elongated strip of metal or plastic 12 and which is bent or otherwise formed at a first end thereof to have a portion 14 extending generally parallel to the plane of the strip 12, but offset therefrom by an integrally formed segment 16. An aperture 18 is formed in the offset portion 14 to facilitate the mounting of the bracket to the frame of a wheelchair as will be further explained hereinbelow. The strip 12 also has a second aperture 20 formed proximate its other end.

The apparatus further includes a second strip of metal or plastic 22 having a longitudinally extending slot 24 formed approximately midway between the side edges of the strip 22. The strip 22 also includes an offset portion 26 having an aperture 28 formed therein to facilitate the mounting of this piece on the frame of the wheelchair.

Figure 2:
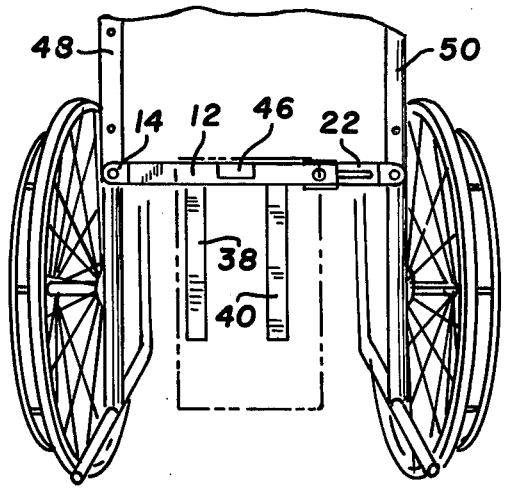
FIG. 2 illustrates the manner in which the embodiment of FIG. 1 is attached to a wheelchair.

As is illustrated in FIG. 2, the strips 12 and 22 are positioned so as to overlap and a U-shaped member 30 having opposed legs straddling the opposed side edges of the strips 12 and 22 is included to prevent relative rotation of these mating parts. The U-shaped member 30 has a central aperture (not shown) formed on the underside thereof so that a screw 32 may pass through the aperture 20 formed in the strip 12, through the slot 24 formed in the strip 22 and through the aperture of the U-shaped bracket 30. A nut is attached to the screw to hold this assembly in place. Because of the slot 24, it is possible to adjust the length of the overall assembly thus far described to accommodate mounting on wheelchairs of varying sizes.

Attached to the strip 12 as by screws 34 and 36 are bag stabilizing members 38 and 40. These bag stabilizing members may be also formed from metal or plastic and extend downwardly from the strip 12 for a predetermined distance and are terminated in the gently curved end portions 42 and 44. These bag stabilizing members are spaced apart from one another by a predetermined distance and approximately midway therebetween and along the length of the strip 12 there is attached an angle bracket 46 which may be welded or otherwise bonded to the strip 12 as illustrated. This angle bracket 46 functions as a hook for engaging the plastic handle commonly found on most catheter bags.

Referring to FIG. 2, the manner in which the catheter bag mounting assembly 10 is disposed on the rear of a patient's wheelchair will now be described. Numerals 48 and 50 indicate the left and right rear side frame members of the wheelchair when viewed from the rear. The left end portion 14 of the unit is attached to the frame member 48 by a screw which passes through the hole 18 and into the wheelchair frame member 48. The location of this mounting connection is proximate to the level of the wheelchair seat. Similarly, the right end portion 26 of the unit 10 is connected to the right rear side frame member 50, also by means of a screw or other type of suitable fastener. When so disposed, the strips 12 and 22 are generally horizontally oriented and the bag stabilizing members 38 and 40 extend downwardly therefrom towards the ground.

When in use, a conventional, commercially available plastic catheter bag is suspended from its handle by the angle bracket 46 and the gently curved bag stabilizing members 38 and 40 are inserted into the bag so as to engage the inside side surfaces thereof. The members 38 and 40 thus prevent the bag from swaying back and forth when in use.

The apparatus of the embodiment of FIG. 1 serves a dual purpose, namely, to support the catheter bag in a relatively stabilized fashion from the rear underside portion of a patient's wheelchair and also to inhibit theft of the wheelchair from a hospital, nursing home or doctor's office. This second function results from the fact that when the catheter bag holding mechanism is attached to the wheelchair, it cannot readily be quickly collapsed and put into a vehicle. Because of the time it would take to disassemble the catheter bag holding structure from the opposed rear side members 48 and 50 of the wheelchair, persons who might otherwise attempt to get away with the wheelchair will be discouraged from doing so.

Figure 3:
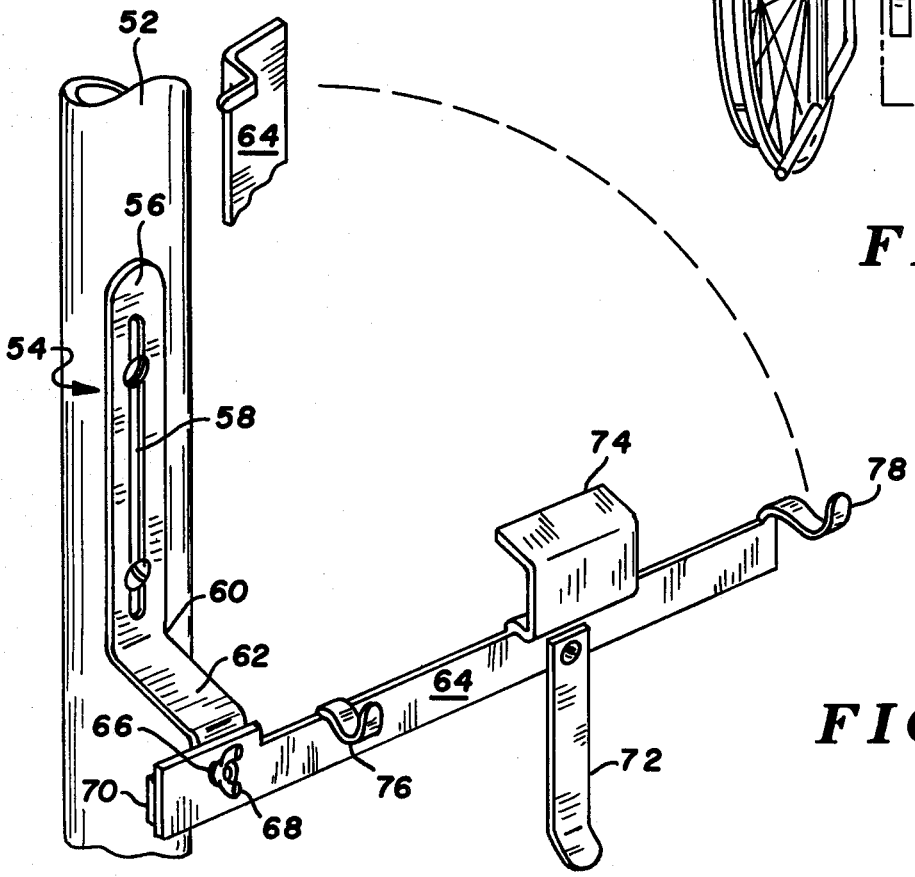
FIG. 3 is a perspective view of an alternative embodiment of the invention.

FIG. 3 illustrates an alternative embodiment of the present invention. In FIG. 3, numeral 52 identifies the left rear side frame member of a conventional wheelchair. Adapted to be attached to this member 52 is an angle bracket indicated generally by numeral 54 having a first leg 56 with a longitudinally extending narrow slot 58 running substantially its entire length and located approximately midway between the side edges of the bracket. At 60, the bracket 54 is bent at substantially a right angle to form a second leg 62 which extends rearwardly from the rear side member 52 of the wheelchair. The leg 52 terminates in a downwardly extending portion which has an aperture (not shown) formed therethrough to facilitate the pivotal attachment of the catheter bag supporting arm 64 thereto.

More specifically, the catheter bag supporting arm 64 comprises an elongated metal or plastic strip having a hole 66 formed proximate the left end thereof to permit it to be attached to the angle bracket 54 by means of a screw and wing nut 68. Attached to the rear side of the bag supporting strip 64 and partially hidden from view is a stop member 70 which prevents the strip 64 from being rotated beyond the horizontal in a downward direction. The pivotal connection provided by the screw and wing nut attachment does permit the strip 64 to be rotated between this horizontal disposition and a generally vertical disposition as illustrated.

Attached approximately midway along the length of the strip 64 is a downwardly depending bag stabilizing member 72 which also has a gently curved terminal portion. The bag stabilizing member 72 may be attached to the strip 64 by any suitable means such as a screw, welding or bonding.

Also located approximately midway along the length of the strip 64 is an integrally formed catheter bag handle hook 74. The hook 74 is formed by bending or molding, depending upon the choice of material used for the strip 64. In either instance, it comprises a generally U-shaped cross section segment having opposed legs separated by a median portion. Thus, the handle of a plastic catheter bag may be engaged by the hook 74 so that the bag will be suspended therefrom with the bag stabilizing member 72 disposed inside of the bag and abutting the opposed side surfaces thereof. Again, the bag stabilizing member 72 serves to prevent the bag from swaying back and forth when suspended in the manner indicated.

First and second outwardly extending fingers 76 and 78 having an upwardly curving terminus portion are also integrally formed with respect to the strip 64, these fingers permitting an opaque fabric cover to be suspended from the arm 64 so as to hide from view the catheter bag and its contents.

The embodiment shown in FIG. 3 permits its use with a folding wheelchair. This is due to the fact that the catheter bag supporting arm 64 is only attached at its left end to the frame of the wheelchair. Thus, when it is desired to collapse the wheelchair, the arm 64 is first rotated upwardly in a counterclockwise direction as indicated by the dotted line and fragmentary portion of the arm 64. When used to suspend a catheter bag from a wheelchair in use by a patient, the attendant merely rotates the arm 64 in a clockwise direction until the stop 70 abuts the downwardly depending portion of the bracket leg 62 which limits the arm's motion to a horizontal disposition. The catheter bag then is placed onto the arm by looping its handle over the hook member 74 with the bag stabilizing member 72 being disposed within the catheter bag. A decorative opaque cover may then be slipped over the plastic catheter bag, the upper lip of the cover being suspended from the upwardly turned finger members 76 and 78.

The catheter bag holders described herein, because of their versatility and convenience, are of significant benefit to patients who suffer from what is pathologically described as incontinence, or the inability to control the natural evacuation of urine. They may be fitted with a Foley catheter which is connected by a tube to a drainage bag which may be conveniently suspended from the catheter bag mounting arrangements of the present invention. Because of the design employed, a catheter bag may be readily attached to the rear underside of a wheelchair where it is somewhat less visible to persons who may be visiting with the patient and thus less embarrassing to the patient himself.

Having shown and described a preferred and alternative embodiment of the invention, it is apparent that various changes and modifications may become apparent to persons skilled in the art and, accordingly, the scope of the invention should be determined from the following claims.

What is claimed is:

1. Apparatus for suspending a catheter bag from the frame of a wheelchair comprising:

(a) an elongated member of adjustable length adapted to be attached at at least one end thereof to the rear vertical side strut of a wheelchair;

(b) at least one bag stabilizing member attached to said elongated member and extending downwardly and perpendicularly thereto for engaging the inside side surfaces of said catheter bag; and (c) a bracket member attached to said elongated member approximately midway along its length and extending upwardly therefrom in a direction opposite to the direction of extension of said bag stabilizing member.

2. Apparatus as in claim 1 wherein said elongated member is attached at each end thereof to the rear vertical side struts of said wheelchair.

3. Apparatus as in claim 1 and further including means for pivotally attaching said elongated member at one end only to a vertical side strut of said wheelchair.

4. Apparatus as in claim 1 wherein said elongated member comprises:

(a) a first elongated strip having an offset portion at a first end thereof, there being a mounting hole formed in said offset portion and an elongated slot formed through said first strip;

(b) a second elongated strip having an offset formed at one end thereof, there being a mounting hole formed in said offset portion and at least one additional hole formed through said second strip;

(c) a generally U-shaped channel having a hole through the central portion thereof and adapted to receive said first and second strips in an overlapping manner therein; and (d) a screw adapted to pass through said hole in said channel, through said additional hole in said second strip and through said slot in said first strip.

5. Apparatus as in claim 1 wherein said bag stabilizing member comprises an elongated strip having a mounting hole at one end portion thereof adapted to receive a screw for attaching same to said elongated member, the other end portion of said bag stabilizing member being curvedly bent out of the plane of the remainder of said strip.

6. Apparatus as in claim 3 wherein said means comprises:

(a) an elongated strip having a slot extending midway along its length and having offset portions at each end thereof, there being mounting holes formed in said offset portions for receiving screws for attaching said elongated strip vertically to said rear side strut of said wheelchair;

(b) a screw passing through said slot and said one end of said elongated member; and (c) a wing nut threaded on said screw.

* * * * *